United States Patent [19]

DeWald

[11] Patent Number: 4,522,258

[45] Date of Patent: Jun. 11, 1985

[54] UNITIZED WELL TESTING APPARATUS FOR USE IN HOSTILE ENVIRONMENTS

[76] Inventor: Jack J. DeWald, 7323 W. Roadway, New Orleans, La. 70124

[21] Appl. No.: 378,107

[22] Filed: May 14, 1982

[51] Int. Cl.[3] ..... E21B 43/00; E21B 43/34

[52] U.S. Cl. ..... 166/57; 166/75 R; 166/DIG. 1; 52/79.7; 52/79.9

[58] Field of Search ..... 166/57, DIG. 1, 75 R, 166/267, 356, 357, 336; 52/79.1, 79.9, 79.7, 637

[56] References Cited

U.S. PATENT DOCUMENTS

| | | | |
|---|---|---|---|
| 3,123,186 | 3/1964 | Adkinson, Jr. et al. | 52/143 |
| 3,643,736 | 2/1972 | Talley, Jr. | 166/267 |
| 4,016,951 | 4/1977 | Dick et al. | 52/143 |
| 4,120,133 | 10/1978 | Rodgers et al. | 52/79.9 |
| 4,221,441 | 9/1980 | Bain | 52/36 |

OTHER PUBLICATIONS

"Construction Tips From the Artic", Alaska Construction and Oil Report, Mar. 1970, pp. 45–54.

"Modular Concepts Used for Multi-Field Platform Equipment", The Oil and Gas Journal, Jan. 1976, pp. 76–84.

"ATCO Schoolhouses Fly to Remote Alaskan Villages", Alaska Construction and Oil Report, Dec. 1972, pp. 35–37.

Winterization; Moore; The Petroleum Engineer, Feb., 1955.

Air-Supported Shelter Will Protect Artic Rigs; Schneidler; World Oil, Feb. 1, 1971.

*Primary Examiner*—Stephen J. Novosad
*Assistant Examiner*—William P. Neuder
*Attorney, Agent, or Firm*—Charles C. Garvey

[57] ABSTRACT

A modular well testing unit for use in hostile environments provides a plurality of modular sections providing upon assembly an enclosed structure for housing the components of the well testing unit, each of the modular sections being self-supporting and transportable. Upon assembly insulation is provided to give an internal controlled environment surrounded by a substantially continuous external shell. Access internally allows movement between adjacent modular sections by personnel, for example. A production intake allows an oil stream from an oil or gas well to be tested to be transmitted to the interior portion of the enclosure. An outlet is provided for discharging oil as well as air, gases, and liquids other than oil such as water. A plurality of well-testing, fluid-handling vessels are disposed respectively in the plurality of modular sections. A manifold forms fluid flow connections between the outlet, the inlet, and the various vessels with the manifold including temporary connections for forming detachable fluid-conveying connections between the different modular units.

9 Claims, 6 Drawing Figures

122
8
150
60
128
120
140
142
50
132
100
123
20
130
125

UNITIZED WELL TESTING APPARATUS FOR USE IN HOSTILE ENVIRONMENTS

BACKGROUND OF THE INVENTION

1. Field of the Invention

The present invention relates to oil/gas well testing equipment and more particularly relates to a transportable, self-supporting, modular well testing apparatus for use in hostile environments.

2. General Background

The search for oil and gas has become increasingly critical due to demand as opposed to available supply. Increasingly, oil companies and their geologists are forced to look for oil in remote portions of the globe including hostile environments such as, for example, arctic and anarctic regions, Canada, and the northern slope of Alaska where temperatures can be sub-freezing for days on end. Working in temperatures of forty degrees below zero (−40° F.) is a necessity at times. Even in such harsh environments, oil and gas well production must be monitored on a daily and often round-the-clock, 24-hour basis in order to monitor certain parameters which indicate well quality, and the quality of crude oil and natural gas flow coming from the well.

Typically, well testing involves the receiving of a stream of fluid from the well which fluid stream includes crude oil, natural gas, water, sand, and various other components as is known in the art. It is also known in the art to treat the crude oil stream with an oil separator which mechanically divides the crude oil stream into its various parts including the oil itself, water, natural gas and other such gases. In typical well testing, a separator is utilized to divide the crude oil stream into its various components so that each fluid component can be measured to determine various parameters such as flow rate, flow quantity, temperature, and various other such desired values. Various well testing components usually include vessels and/or flow components, surge tanks, heat exchangers (steam, diesel, etc.), pumps, laboratory equipment, piping, meters and the like.

In hostile environments, equipment and personnel are put under a serious strain which can often lead to non-functioning or poor functioning of equipment. In arctic well testing, parameter values are sometimes taken at undesirably long intervals and with crude instruments which must necessarily be tough enough to withstand temperatures which can reach many degrees below zero and can cause more delicate instruments to ice-up and freeze. This creates error sources that can prove costly in properly evaluating a new well.

In the prior art, well testing equipment used in harsh environments has been wrapped and insulated on a piecemeal basis for protection with the personnel individually operating such piecemeal equipment by moving through the ice and snow from vessel to vessel and from valve to valve in order to operate the well testing equipment in such harsh circumstances. Fluctuations in weather can interrupt normal operations. At times an unattended technician will not make the measurements as often as are required and frequently the values taken for such measurements are erroneous because of the severe environment in which they are taken. Sometimes the valves, guages, and meters do not function properly because they are caked with ice and snow.

In such a harsh environment the incentive is quite low for an operator on site to perform his job with accuracy and with precision over a long period of time such as, for example, on twelve to twenty-four man-hour shifts.

Well testing equipment typically utilizes a number of valves which are used to open and close various flow lines and vessel so that oil/gas can be transmitted between the various components of the system as desired in order to perform the various well testing operations. These valves can become caked with ice and snow making their operation impossible or difficult in many instances. Some of the valves utilized in oil and gas well testing are relief-type valves which must discharge pressures in excess of design pressures for the system. Malfunction of these valves can be critical being a source of hazard and possibly catastrophe.

Inspection of well testing equipment and of well testing personnel by oil company officials or persons with the United States Geological Service, and other various agencies charged with protection of the environment becomes another problem where such officials must be required to travel through snow and ice in sub-zero temperatures to visit various well testing sites to visually inspect the equipment, its connections, and its proper functioning. When this equipment is caked with ice and snow, its inspection becomes difficult and indeed the harsh environment prevents the inspector from staying on site for any large period of time even when he is wearing heavy arctic gear and protective clothing.

An additional problem in the utilization of well testing equipment in harsh remote areas such as the north slope of Alaska or in Arctic or the like is the problem of transportation of the equipment to the site and its subsequent assembly. Most areas near the well site are covered with ice and snow and thus, specialized vehicles must be utilized in order to move equipment on site and off site. Equipment must not only be transportable, but is usually subjected to harsh treatment in transit. Roads can be unpaved, full of potholes and patterned with irregular, repetitive, bumpy surfaces which set up excessive vibration that can tear apart equipment. Lifting is often by forklift where the entire equipment weight is placed on a few square inches of surface, creating high stresses. A further problem is the assembly of equipment at its final destination in a sub-freezing environment where personnel can generally work only at reduced capacity for short periods of time due to the severeness of the environment, the occurrence of white outs, and the like.

It is to these problems that the present invention is directed.

Several devices have been patented showing various modular equipment/housing units directed to solving various problems. None of these devices teach the combination of the present invention and its solution to well testing in a harsh environment such as in arctic regins of the globe.

U.S. Pat. No. 4,016,951 issued to Charles W. Dick, et al, is entitled "Air Transportable Seismic Exploration System for Use on Ice-Covered Waters." That patent discloses a system which comprises a housing which contains equipment such as an engine, a compressor, means for boring holes in the ice, and acoustic signal generating means that can be lowered into the water through the holes in the ice. The housing is sufficiently lightweight that is can be easily transported from one location to another by helicopter or other aircraft. The heat generated by the engine is sufficient to provide a comfortable working environment for personnel within the housing and helps preventing freezing of equipment located within the housing.

"Modular Housing Units" is the subject of U.S. Pat. No. 4,012,871 issued to T. Netto, et al.

A "Collapsible Prefabricated House" is the subject of U.S. Pat. No. 3,992,828 issued to T. Ohe.

A prefabricated room cell in the subject of U.S. Pat. No. 3,633,323 issued to K. Eriksson, et al.

A prefabricated utility system is the subject of U.S. Pat. No. 4,221,441 issued to William Bain.

A "Method of Constructing a Transportable Prefabricated Room Element" is the subject of U.S. Pat. No. 4,120,133 issued to Franklin Rogers, et al. The room element has a rigid frame or chassis consisting of a full panel, composed of prefabricated panel sections rigidly connected in an end-to-end assembly by structural means, and prefabricated vertical load-bearing structures, rigidly connected to the panel adjacent the ends thereof, for supporting superimposed parts (for example, the roof or ceiling, or a superimposed room element). At least one of the load-supporting structures may be integral with a panel section. The panel sections form the bases of the corresponding regions of the room element and at least one of them is incorporated in a three-dimensional prefabricated room element section, of unit form, which unit comprises such vertical load-bearing or non-load-bearing structures substantially all of the installations, required in that part of the completed room element. The unit may be a bathroom unit, a staircase unit, heating unit, elevator shaft unit, or kitchen unit.

A "Portable Building" mounted upon skids is the subject of U.S. Pat. No. 3,023,463 issued to F. E. Bigelow, Jr.

Another shelter which is the subject of a patent is U.S. Pat. No. 3,123,186 issued to C. A. Adkinson, Jr., et al, entitled "Wall Construction for Shelter."

3. General Discussion of the Present Invention

The present invention solves the prior art problems and shortcomings in a simple, straightforward yet effective manner by providing a modular well testing unit for use in hostile environments which comprises a plurality of modular sections, the sections upon assembly forming an enclosed structure for housing the components of the well testing unit. Each modular section is rugged, self-supporting, and transportable by several available means including by air transport, truck, or rail. The construction allows compactness allowing loading on aircraft where space and weight are limited. The sections are assembled together by bolting structural members, for example, and by providing detachable fluid conveying connections between the different modular units for the various piping provided. Insulation is placed on walls which will be exterior walls upon assembly. Insulation provided on each individual module thus forms upon assembly an internal controlled environment which is surrounded by a substantially continuous external insulated shell. Walls which will be external and part of the shell are insulated while internal walls are preferably open allowing access between the adjacent modular sections. A sheet metal skin covers those walls of the modular section which will upon assembly form part of the external shell. The skin is first exteriorly welded to the frame and that skin is covered with fireproof fiberglass insulation batts held in place by wire or like means. Internally, access is allowed between adjacent modular sections for movement personnel as is necessary for the well testing operation. Electric wiring for lighting, heaters, pumps, computers, metering equipment and the like is explosion proof to prevent explosion in case of gas leaks. Junction boxes are also provided at interface of adjacent modular units with explosion-proof, electrical unions forming connections. Thus, the entire apparatus upon assembly is entirely pre-wired and explosion proof. The enclosed insulated environment allows, if desired, interior warming with connection heating. An intake line allows a production stream from an oil/gas well to be tested to be transmitted to the interior portion of the shell. Outlets are provided for discharging oil and other separated fluids from the assembled enclosure. A plurality of well testing fluid handling vessels are disposed respectively in the modular sections. A manifold for forming fluid flow connections between the outlet, the inlet, and the various vessels is provided with the manifold including detachable connections between the different modular units.

The present invention thus provides a controlled environment for not only personnel but for the well testing equipment itself, the manifolding, the various valves and connections, and electrical and metering equipment.

The present invention further provides a controlled environment which allows the use of sophisticated well measuring and data processing equipment, computers and the like and protects such equipment from the external hostile environment.

It is thus an object of the present invention to provide a modular well testing unit for use in hostile environments which can withstand severe temperatures for long periods of time without excess maintenance, needing a minimum of personnel for its operation.

Another object of the present invention is to provide a modular well testing unit for use in hostile environments having various modular section components which are prefabricated, structurally self-supporting, and individually transportable even over rough terrain which creates severe, potentially damaging shock or vibration, and can be assembled on site with a minimum of effort.

It is another object of the present invention to provide a modular well testing unit for use in hostile environments in which complete manifolding allows a comprehensive fluid flow interface between all of the module sections of the well testing unit.

It is another object of the present invention to prove a modular well testing unit for hostile environments where manifolding, interconnecting piping and flow route selection by operators is in an internal controlled environment.

Another object of the present invention is to provide a modular well testing unit for hostile environments which allows internally, access between the various modular sections after the entire assembly has been completed.

Another object of the present invention is to provide a modular well testing apparatus which is hazard-free from explosions.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
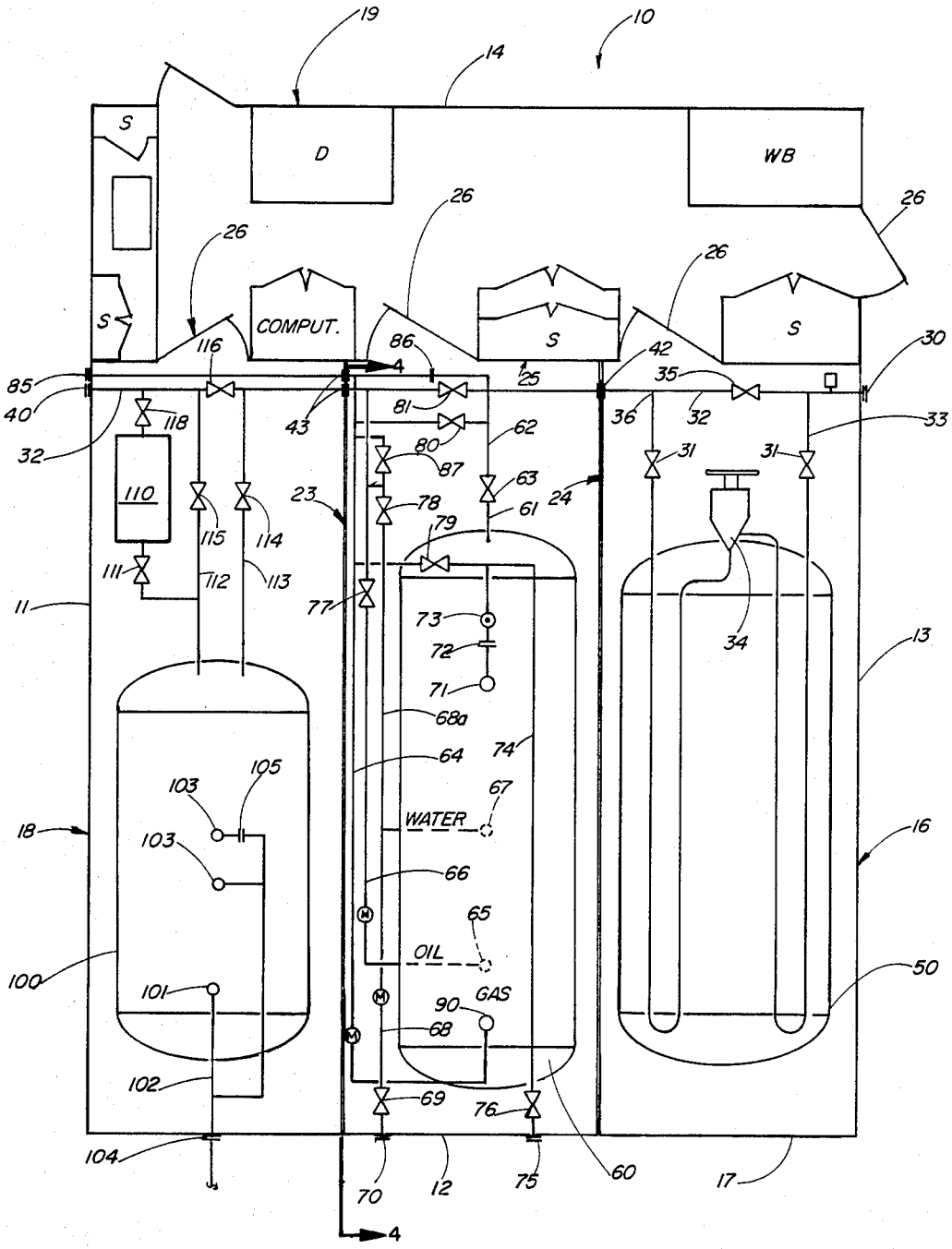
FIG. 1 is a schematic diagram of the preferred embodiment of the apparatus of the present invention.

FIG. 1 illustrates generally the preferred embodiment of the apparatus of the present invention designated generally by the numeral 10.

Figure 2:
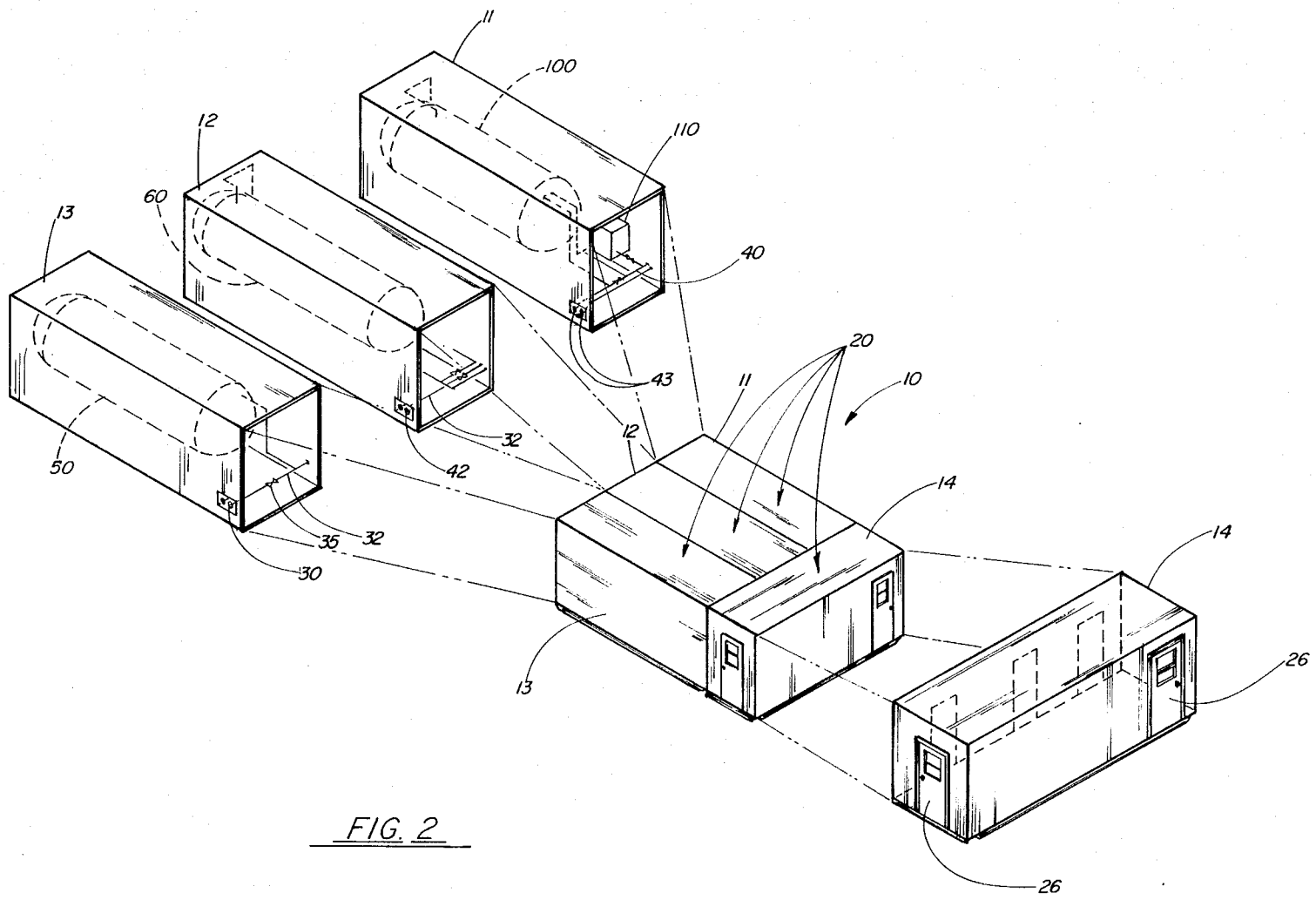
FIG. 2 is a perspective, exploded view of the preferred embodiment of the apparatus of the present invention.

Modular well testing apparatus 10 provides a plurality of modular sections 11–14, each of which is self-supporting and transportable. Modular sections 11–14 provide upon assembly an enclosed structure for housing the components of the well testing unit. FIG. 2 illustrates schematically assembly of modular sections 11–14 into the overall enclosed structure. An external insulated shell which is substantially continuous is formed upon assembly of the modular sections 11–14. In FIG. 1, a continuous outer sidewall is shown as comprising sidewalls 16–19. Only walls 16–19 need be provided with insulation. This would include the two external walls of module 11, the single external wall of module 12, the two external walls of module 13, and the three external walls of module 14.

An uppermost shell surface 20 is formed by the assembly as is also provided a lowermost floor 22. Those portions of each module forming roof 20 and floor 22 would be insulated. The modular sections 11–14 would be connected together using bolted connections, for example, between the various steel structural members forming each modular unit (see FIGS. 3–5) as well as connections in the form of detachable fluid conveying and electrical connections as will be described more fully hereinafter.

Internal walls 23–25 would be open allowing access between the various modules 11–14. Alternatively, module 14 would provide a solid sidewall 25 having door openings 26 as shown which would allow closure of opening of the access doors 26 as desired. A production stream intake 30 would be a detachable connection such as, for example, a flanged or union connection which would provide an intake for a fluid production stream from an oil/gas well to be tested. Connection 30 would be connected to a pipeline coming from the well head and would form the intake of production gas and fluid to apparatus 10 for further testing, separation and the like. A manifold line 32 is shown as moving between production intake 30 and crude oil outlet 40. Outlet 40 would provide a discharge for oil from the assembled enclosure 10.

Manifolding from manifold line 32 to various well testing units would be achieved as specified hereinafter. Manifold 32 would allow the formation of fluid flow connections between inlet 30, outlet 40, and various well testing vessels with the well testing fluid handling vessels being disposed respectively in each of the modular sections 11–14. In FIG. 1, modular section 13 would house steam heat exchanger 50. Modular section 12 supports and contains separator 60 while modular section 11 supports and contains surge tank 100 and transfer pump 110.

Modular section 14 would be, for example, a laboratory holding appropriately desks D, work benches WB, storage S, and a source of water but would also provide, for example, sophisticated measuring equipment such as a computer and appropriate interfacing between the computer and various measuring devices located generally upon modules 11–13.

Line 33 would proceed from manifold 32 into steam heat exchanger 50 and interface therewith, intersecting choke 34 and thereafter exiting for connection to manifold 32 downstream of valve 35 at connection 36. Ball valves or gate valves could be provided for shutting off the flow of fluid from steam heat exchanger 50 to manifold 32 as would be desirable, for example, in a cleaning of the well at which time flow would be directly through the entire apparatus from inlet 30 directly through manifold 32 and outlet 40.

A detachable temporary fluid conveying connection is provided between the different modular units 11–14. For example, union 41 is shown in FIG. 1 as forming a detachable fluid conveying connection between modular units 12 and 13. Similarly, unions 43 form detachable fluid conveying connections between modular units 11 and 12. Separator 60 provides an inlet 61 which allows entry of crude oil into separator 60 through line 62. Valve 63 provided at inlet 61 of separator 60 could be closed during manifolding, for example, where flow would be between inlet 30 and outlet 40 or surge tank 100 for cleaning of the well, for example. Within separator 60 there is provided oil outlet 65 and oil line 66 for removing separated oil from separator 60. Water outlet 67 and line 68 provide for the discharge of water through valve 69 and water outlet 70. Pressure relief outlet 71 is provided with rupture disk 72 and optionally, relief valve 73, while line 74 carries gas to outlet 75 through valve 76 or to valve 79 for recombing with line 64. Optionally, water can be recombined with oil by closing valve 69 and allowing water to flow through line 68A for recombining to the oil line 66 after leaving oil outlet 65. Valves 77, 78 would control the recombination of oil and water if desired in combination with a closure of valve 69, the normal water discharge line. Valve 80 when open would allow water to be recombined with gas flowing through line 64. Valve 80 would typically be closed. Valve 78 when open allows recombination of water with oil of line 66 when valve 80 is closed. Valve 77 can be used to cut off line 66 as during manifolding through line 32, such as during well cleanup. Meters "M" are shown respectively in lines 66, 68 and 64 to monitor flow of components, oil, water and gas.

Valve 81 would be placed in manifold line 32 and would be normally closed allowing circulation from line 32 into vessel 60. However, valve 81 would be open in combination with a closure of valves 31, 80 and 63 if manifolding were desired such as during a cleaning of the well. As a safety release, line 85 is provided and is equipped with rupture disk 86 as well as an outlet in the form of a detachable flanged connection, union or the like. Relief line 85 and manifold 32 each would provide a detachable connection 43 between modular sections 11, 12. Valve 87 would provide for a recombination of water with either gas discharge line 64 or oil disharge line 66 depending upon whether it were closed or open as desired.

Surge tank 100 provides a gas outlet 101 and gas discharge line 102 which would be provided with an external detachable connection 104 such as a union or a flanged connection. Gas relief outlet 103 is provided with a rupture disk 105. A popoff valve could be provided if desired on surge tank 100.

In order to add pumping head as desired, transfer pump 110 would be provided which would be interfaced by means of valve 111 to discharge line 112. Surge tank 100 would intake oil through line 113 when valve 114 were open. Valve 115 would be closed when line 111 were open allowing circulation through pump 110. Alternatively, valves 111 and 118 would be closed and valve 115 opened if oil were to be transmitted through line 112 circumventing pump 110. Valve 116 is provided in manifold line 32 and valve 118 is provided in the line which connects pump 110 to manifold 32.

From the foregoing it can be seen that a complete manifolding of all of the well testing fluid handling vessels is provided. Thus, fluid conveying is achieved among all of the various units.

Figures 3, 4, 5, 6:
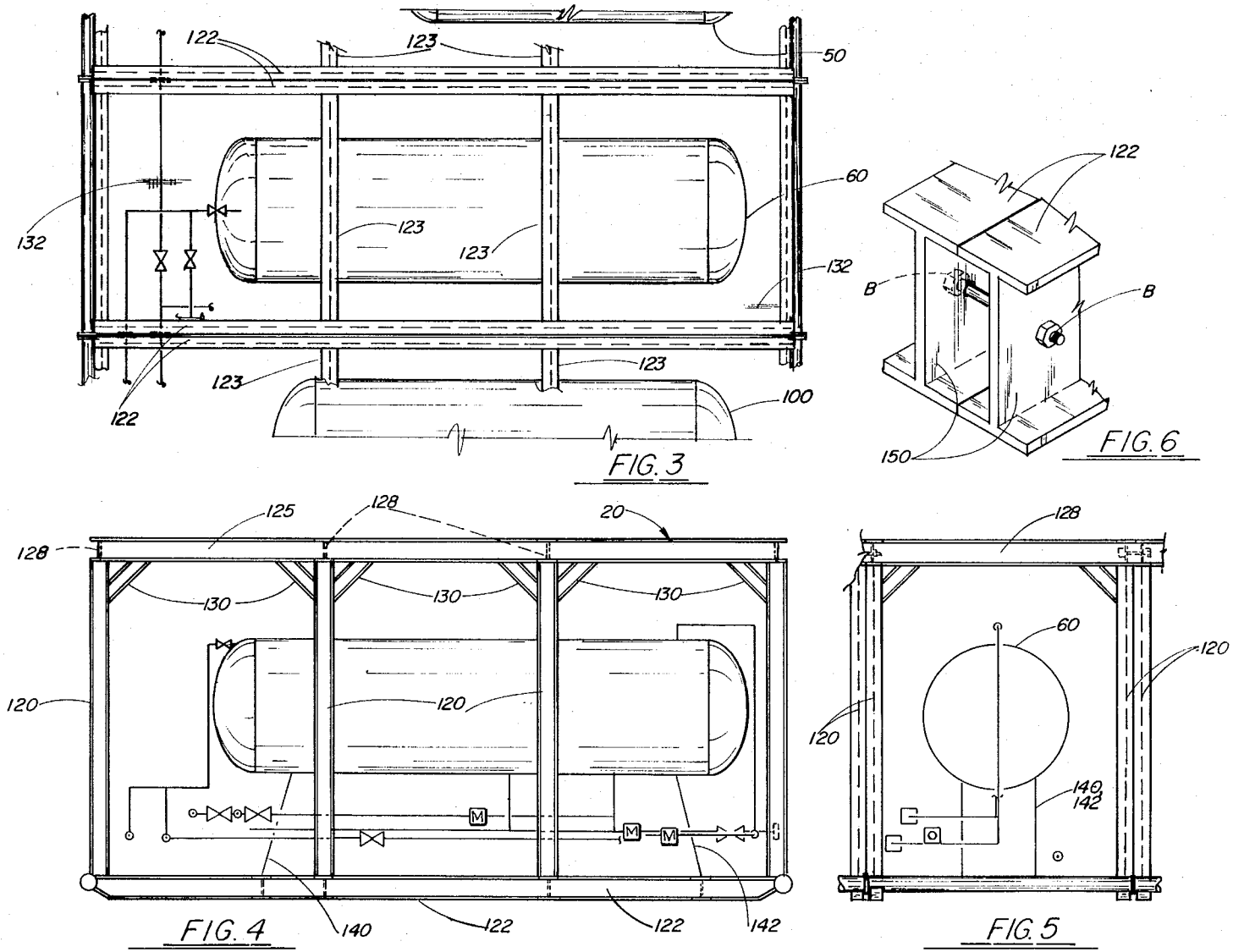
FIG. 3 is a top view of the preferred embodiment of the apparatus of the present invention illustrating a plurality of the modular section portions thereof.
FIG. 4 is a side, elevational view of the preferred embodiment of the apparatus of the present invention.
FIG. 5 is an end elevational view of the preferred embodiment of the apparatus of the present invention.
FIG. 6 is a perspective view of the preferred connecting means of the present invention.

FIGS. 3 through 5 illustrate more particularly the preferred embodiment of the apparatus of the present invention showing the structural frame portion of the various modular sections 11–14. Each modular section 11–14 is structurally self-supporting and transportable, providing a lowermost floor 22, an uppermost roof 20 and a plurality of connecting columns 120. Floor 22 would be constructed of a pair of spaced apart longitudinal I-beams 122 and a plurality of transverse I-beams 123 spanning therebetween. The transverse I-beams 123 would preferably be of a uniform length as would the longitudinal I-beams. The end portions of each longitudinal floor I-beam could be provided with a rake 124 allowing each entire module section to be slid as, for example, during loading, assembly, disassembly and/or transportation.

Similarly, roof 24 would be provided with spaced longitudinal I-beams 125 and a plurality of transverse I-beams 128. Diagonal members 130 would be provided for stiffening.

Floor 22 provides covering 132 of, for example, grating or checkplate as desired.

An oil drip pan of sheet metal would be provided continuously on the lowest portion of floor 22 for catching any leakage from the various vessels used in the well testing modular units. In the preferred embodiment, this would be a continuous flat plate spanning the entire surface of floor 22 below I-beams 122, 123 but welded or otherwise connected thereto.

A pair of yokes 140, 142 of structural steel, for example, would form a support between each vessel and one of the transverse floor I-beams 123. Yokes 140, 142 would be welded to I-beams 123 and to the appropriate supported vessel. Connections between adjacent modules is by bolted connections B between the longitudinal I-beam webs 150 as shown in FIG. 6.

Each module frame comprising longitudinal I-beams 122, 125; transverse I-beams 123, 128; columns 120 would be assembled by welding to form a unitized frame for each module which is rugged, being liftable from top, bottom, side or ends yet fully transportable and self-supporting.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A modular well testing unit for use in hostile environments, comprising:

a. a plurality of modular sections providing upon assembly a composite, unitized, enclosed structure for housing the components of the well testing unit, each modular section being self supporting and transportable;

b. means for assembling the modular sections together to form the composite, unitized, enclosed structure;

c. wall and insulation means for each of the units which are adapted to provide upon assembly of the modular sections an internal controlled environment surrounded by a substantially continuous external shell;

d. internal access means between adjacent sections for allowing access between adjacent modular sections without traveling outside the external shell;

e. production fluid intake means for intaking a production gas/fluid stream from an oil/gas well to be tested;

f. crude oil outlet means for discharging oil from the assembled enclosure;

g. a plurality of well testing fluid handling components comprising at least in part heat exchanger means, surge tanks, transfer pump and separator means for separating the production stream into components disposed respectively in said modular sections; and h. manifold means in each modular unit for forming fluid flow connections between the outlet means, the inlet means and the components, said manifold means including connection means for forming easily detachable direct fluid conveying connections between adjacent modular units so that the manifold means for all the modular units can be connected without traveling outside the external shell.

2. The apparatus of claim 1 wherein each modular section comprises a structural steel frame at least in part.

3. The apparatus of claim 2 wherein said frame comprises a plurality of spaced apart longitudinal I-beams and a plurality of spaced apart transverse I-beams spanning respectively between the pair of longitudinal I-beams, a plurality of upwardly extending support columns and a framed roof affixed to the upper portion of the columns.

4. The apparatus of claim 1 wherein said manifold means comprises connecting piping carried by said modules and detachable connections provided on said piping at the edge portipon of each module, with piping of adjoining modules abutting upon assembly at the detachable connections.

5. The apparatus of claim 1 wherein some of the modular sections are generally rectangular and of corresponding dimensions allowing side by side alignment for assembly.

6. The apparatus of claim 1 wherein said assembling means comprises in part bolted connections between adjacent modules.

7. The apparatus of claim 1 wherein said internal access means comprises spaces formed in the walls of adjacent modular units.

8. The apparatus of claim 1 wherein said insulation means comprises upon assembly of the modular units, a substantially continuous floor, a substantially continuous roof covering, and an outer sidewall spanning between the edge portions of the floor and the roof, with the floor, the roof and the outer sidewall comprising portions of the individual modular units.

9. The apparatus of claim 1 wherein said manifold means provides in part a prefabricated piping system on each module and transportable therewith.

* * * * *